United States Patent [19]

Peirce et al.

[11] Patent Number: 4,654,014

[45] Date of Patent: Mar. 31, 1987

[54] OUTBOARD MOTOR TRIM SYSTEM

[75] Inventors: James G. Peirce, Madison Lake; Maurice A. Sween, Lake Crystal, both of Minn.

[73] Assignee: Sween Corporation, Lake Crystal, Minn.

[21] Appl. No.: 783,017

[22] Filed: Oct. 2, 1985

[51] Int. Cl.[4] ..... B63H 21/26

[52] U.S. Cl. ..... 440/59; 440/80; 248/642

[58] Field of Search ..... 440/53, 58, 59, 61, 440/63, 79, 80; 248/640–642; 403/381

[56] References Cited

U.S. PATENT DOCUMENTS

| | | | |
|---|---|---|---|
| 708,476 | 9/1902 | Higgins | 114/219 |
| 2,966,876 | 1/1961 | MacWilliam | 440/61 |
| 2,972,328 | 2/1961 | Hodgson | 440/59 |
| 2,999,476 | 9/1961 | Johnson | 440/61 |
| 3,053,489 | 9/1962 | Robinson et al. | 248/642 |
| 3,116,710 | 1/1964 | Cass | 440/61 |
| 3,250,240 | 5/1966 | Ziegler | 440/61 |
| 3,434,450 | 3/1969 | McCormick | 440/61 |
| 3,473,325 | 10/1969 | Vargo | 60/468 |
| 3,486,724 | 12/1969 | Adamski | 248/642 |
| 3,587,513 | 6/1971 | Stimatze | 440/61 |
| 3,945,544 | 3/1976 | Walker et al. | 403/381 |
| 4,044,705 | 8/1977 | Roberts | 440/61 |
| 4,403,969 | 9/1983 | Pichl | 440/59 |
| 4,410,157 | 10/1983 | Monti et al. | 403/381 |

*Primary Examiner*—Joseph F. Peters, Jr.
*Assistant Examiner*—Stephen P. Avila
*Attorney, Agent, or Firm*—Harold D. Jastram

[57] ABSTRACT

The invention involves an electromechanical mechanism for controlling the trim and tilt of an outboard motor mounted on outboard powered boats. Trim arms are pivotally mounted from brackets attached to a boat transom. The trim arms move the outboard motor prop housing relative to the boat transom and bottom of the boat by use of an electromechanical motor mechanism.

10 Claims, 10 Drawing Figures

OUTBOARD MOTOR TRIM SYSTEM

BACKGROUND OF THE INVENTION

A common propulsion system for a marine craft is of the outboard type where the motor is suspended from the transom of the craft. Generally this power system is an internal combustion cylinder and piston type power plant mounted generally on a transom in a position to extend a propeller from the motor through a drive shaft connection to the power plant. A housing extends downwardly from the motor and connects the piston motor to a lower housing in which a transmission mechanism is enclosed and which directs the power from the motor to a propeller which engages the water and directs the thrust of the propeller generally horizontal to the bottom of the boat. A usual feature of the lower housing of the power plant is a horizontal extension commonly referred to as a cavitation plate. This cavitation plate functions to stabilize the craft from the forward thrust of the propeller. The stabilizing effect of the cavitation plate, along with the control of the direction of thrust by the propeller, is to a great extent dependent upon the positioning of the propeller relative to the bottom surface of the boat and therefore also relative to the mounting bracket which mounts the power plant to the boat transom.

Commonly the power plant or outboard motor is pivotally mounted on the outboard motor boat transom via a transom bracket through the use of a horizontally positioned transverse axis connection. Normally the transom brackets are of the inverted U type with one of the legs of the bracket connecting the outboard side of the transom of the marine craft while the inboard extension of the bracket extends downward along the forward or inner surface of the transom. These brackets commonly also employ some device for clamping the generally inverted U shaped bracket to the transom. The prior art apparatus generally utilized permitted the motor to be mounted on the transom in such a manner that it could be adjusted for the desired horizontal positioning of the propeller along with the cavitation plate. This adjustment was provided for so that the propeller thrust direction and the cavitation plate could be aligned relative to the bottom contour of the craft. In power boating applications, it is normally desired to have the boat "plane" in order that the maximum thrust from the propeller can be directed in the optimum direction relative to the movement of the boat. Optimum power thrust from the propeller increases the operating efficiency, economy and the speed which can be achieved from a specific combination of boat and motor.

Normally, boats employing outboard motors are loaded differently each time the boat is used. Consequently, it is not uncommon that the boat will require a different trim of the propeller for each use situation. The balance of the boat which is affected by the load, the total load of the boat and similar physical characteristics will determine the power conditions under which the boat will "plane" to thereby achieve the maximum efficiency. Further, for a given set of loading conditions, it is initially desirable to provide a maximum lift at the stern of the boat when the boat is first placed under power. Once the boat is underway, however, the maximum efficiency is achieved by adjusting the angle of thrust of the propeller as the boat approaches and achieves the planing condition relative to the surface of the water. Trimming is therefore necessary in order to achieve this maximum efficiency. Further, the proper positioning of the cavitation plate along with the propeller to achieve minimum cavitation likewise adds to the efficient operation of the boat.

Typically the mounting mechanism utilizing the U-shaped bracket is utilized for the outboard motor which provides a predetermined and limited number of fixed position stops for adjusting the trim of the motor. This is achieved by a mechanism connecting the motor to the transom bracket and the motor hanger. The fixed positional stops, while limited in number, permit some manual adjustment of the cavitation plate and propeller with respect to the hull bottom of the boat and thereby achieve greater efficiency. This type of mechanical adjustment apparatus, however, is of limited use because it provides a limited number of adjustment positions. Further, such mechanisms must be manually adjusted and normally cannot be adjusted in the presence of propeller thrust. Accordingly, the mechanism cannot be used to vary the trim of the motor when the boat is under propeller power. Consequently, the use of such an adjustment mechanism requires a compromise in the adjustment position. The compromise is between positioning the propeller for starting the boat under load and achieving some efficiency after the boat begins to plane.

In order to improve the efficiency and performance of an outboard motor boat at a variety of speeds, it is therefore necessary to provide an unlimited number of adjustments of the direction of thrust of the propeller. This unlimited adjustment capability is particularly useful for small motor boats of the type that utilize outboard motors because such small craft are dramatically influenced by the loading fore and aft. Further, the performance of these boats varies dramatically at high and low speeds with the most desired and efficient position of the boat in a planing position high in the water where the boat is not permitted to plow through the water. To be of any practical value, the mechanism used to position the propeller thrust and the attitude of the cavitation plate must be power assisted. The power assist mechanism should be convenient for operation by the boat operator while the boat is under power and should have adequate range of positioning to permit the operator to achieve maximum lift capability when the boat is started and maximum plane efficiency when the boat is under high speed operation.

A typical attempt to achieve a more efficient trimming of the motor boat propulsion system is illustrated in the following U.S. patents:

| | | |
|---|---|---|
| No. 2966876 | No. 3250240 | No. 3486724 |
| No. 3053489 | No. 3434450 | No. 3587513 |
| No. 3116710 | No. 3473325 | |

All of the above patents disclose a power trim system which, with varying degrees of success, use a hydraulic system to adjust the trim of the boat and also to tilt the motor out of the water on occasions when the boat is at dock. All of this prior art contains the common disadvantage of utilizing a hydraulic system. The hydraulic system requires an electric power system to operate the hydraulic system which in turn provides the power to the boat trim mechanism. This hydraulic system has as a characteristic the undesirable use of fluid, tubes, reservoirs and the likelihood of leaks in that system including a significant loss of efficiency in the system.

SUMMARY OF THE INVENTION

It is therefore an object of the present invention to provide a trim and tilt apparatus for adjusting the trim and tilt of an outboard power plant to achieve efficient delivery of propulsive power during operation of an outboard motor on a water craft.

Another object of the present invention is to provide an adjustable trim for an outboard motor on a water craft by the boat operator while the craft is underway and the outboard motor propeller is delivering propulsion power to the boat.

A further object of the present invention is to provide an electromechanical power trim apparatus capable of substantially unlimited positioning of an outboard motor mounted on the transom of a water craft while the motor is delivering power to propel the craft through the water.

Another object of the present invention is to provide an electromechanical device capable of supporting an outboard motor while it is operating at maximum thrust and while also inoperable when the boat is docked or out of the water.

Yet another object of the present invention is to provide an electrically powered trim mechanism providing unlimited positioning of an outboard motor while mounted on a boat transom and while the motor is either in the operating position or inoperable.

DESCRIPTION OF THE DRAWINGS

This invention will be more particularly described in reference to the accompanying drawings where.

DETAILED DESCRIPTION OF A PREFERRED EMBODIMENT OF THE INVENTION

Figure 6:
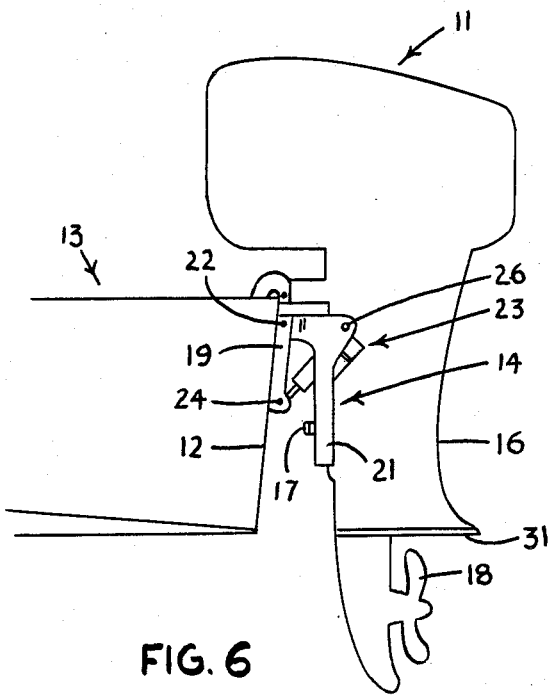
FIG. 6 is a side view of an outboard motor mounted on the transom of a boat with a trim apparatus positioning the motor in the operational position.

Refer first to FIG. 6 of the drawings which depicts a preferred embodiment of the invention having an outboard motor generally designated by 11 mounted on a transom 12 of an outboard motorboat 13. A trim and tilt mechanism generally designated by 14 is in an operative position relative to the housing 16 of the outboard motor 11 so that a cross arm 17 contacts the motor housing 16. The positioning of the tilt mechanism 14 in FIG. 6 illustrates the positioning of the motor 11 in a vertical position so that the thrust of propeller 18 is horizontally to the rear of the boat as depicted in FIG. 6 of the drawings. The word "tilt" will be used to describe the invention, but it must be understood that it refers to the function of "trimming" an outboard motor as well as "tilting" the motor. Therefore, tilt should be considered synonymous with the word "trim" for the purposes of this application.

The tilt mechanism 14 is connected to the transom 12 of the boat 13 by mounting brackets 19. A force arm 21 is connected to mounting bracket 19 at pivot point 22. Cross arm 17 is also connected to force arm 21. Bracket 19 may be mounted at any vertical location on the transom 12. This means that by simply adjusting the vertical location on transom 12 where the bracket 19 is mounted, the tilt mechanism 14 can be adjusted to accommodate an unlimited variety of motor size, housing 16 length, transom 12 size and boat depth. This adjustable characteristic is extremely useful in view of the great variety of boat and motor sizes currently available to the consumer. This adjustable feature of bracker 19 is further enhanced by an adjustable feature of cross arm 17 which will be more fully explained hereinafter.

Figure 4:
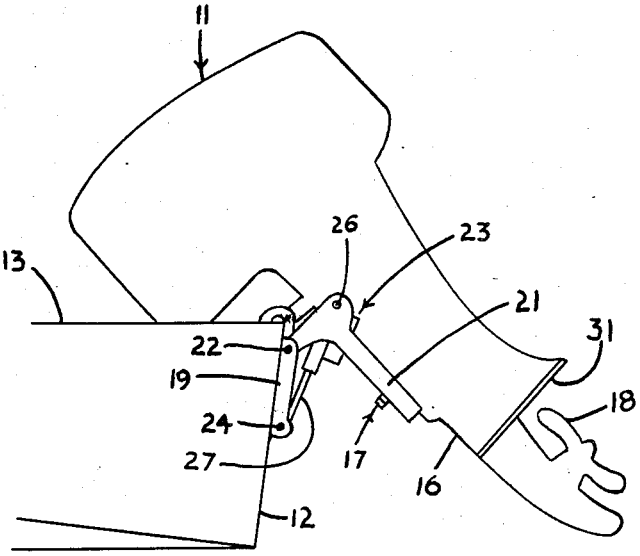
FIG. 4 is a side view of an outboard motor mounted on the transom of a boat with a trim apparatus positioning the motor in a tilted and inoperable position.

An electromechanical linear actuator 23 is mounted between a pivot point 24 on mounting bracket 19 and the upper end of force arm 21 at pivot point 26. Electromechanical linear actuator 23 is the power source for moving the force arm 21 in an arc about pivot point 22 thereby carrying the attached cross arm 17 along with the lower portion of force arm 21 and thereby moving the outboard motor 11 to a different trim or a tilted position. The tilted position is better illustrated in FIG. 4 of the drawings where motor 11 is illustrated in the fully tilted position similar to that used when a boat is at dock or in storage. In FIG. 4 of the drawings the force arm 21 is tilted away from the transom 12 of the boat 13 in the same position that force arm 21 would occupy if the boat were at dock or in storage. In this position, the motor 11 is pivoted so that the propeller 18 and the lower portion of the housing 16, including the cavitation plate 31 is out of the water.

The fully tilted position illustrated in FIG. 4 of the drawings is achieved by electrical power to the linear actuator 23. The linear actuator 23 has a drive shaft 27 which extends from and is a part of the linear actuator 23, the function of which will be explained more fully hereafter. When the linear actuator 23 is extended for its total length through the use of the drive shaft 27, force is applied at pivot points 24 and 26. By changing the distance between pivot points 24 and 26, the linear actuator 23 forces force arm 21 to pivot about pivot point 22 thus rotating the lower extension of force arm 21 around pivot point 22 in an arc between the position illustrated in FIG. 4 and the positions illustrated in FIG. 6 of the drawings. Since cross arm 17 is in physical contact with the lower motor housing 16, the outboard motor 11 is rotated along with the force arm 21 and the cross arm 17 to the position illustrated in FIG. 4. The motor housing 16 is not connected to cross arm 17. When the tilt mechanism 14 is rotated about pivot point 22 from the position shown in FIG. 4 to the fully tilted position shown in FIG. 6, the cross arm 17 pushes the motor housing. This is accomplished by using linear actuators such as actuator 23. When the linear actuators are reversed, the forces of gravity pushing the motor housing against the cross arm 17 and/or the thrust of propeller 18 moving the boat moves the motor housing 16 and tilt mechanism 14 in an arc about pivot point 22 from the position illustrated in FIG. 6 of the drawings to that illustrated in FIG. 4 of the drawings.

Figure 5:
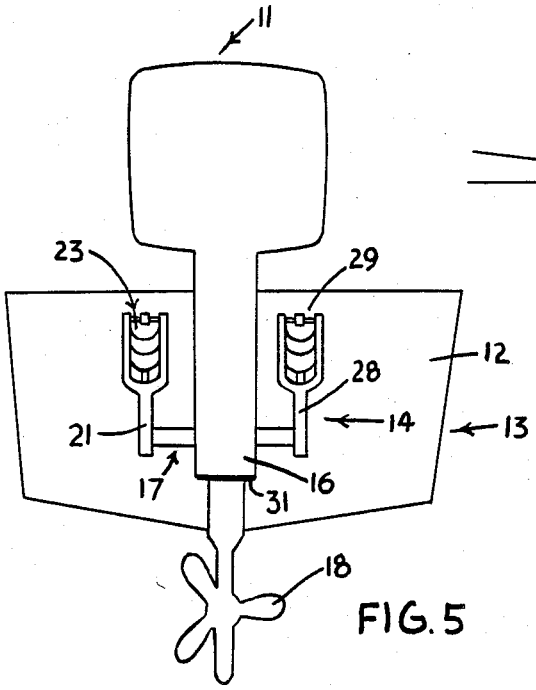
FIG. 5 is a back view of an outboard motor and a trim apparatus mounted on a boat transom showing the motor in the operative position.

Refer now to FIG. 5 of the drawings which shows the tilt mechanism 14 mounted on the transom 12 in a back view. From this view it is apparent that one version of the tilt mechanism 14 contains two force arms. This is a version used in connection with a single motor. Force arm 21 is mounted on the left and force arm 28 is mounted on the right as viewed in FIG. 5 of the drawings. Cross arm 17 interconnect force arms 21 and 28 in this view and as indicated previously is the element of the tilt mechanism 14 which carries the motor to the different tilt and trim positions. Force arm 28 is powered by a linear actuator 29 which is identical to linear actuator 23. The linear actuators 23 and 29 are electrically controlled by an electrical control circuit 69 and power source 20. Both of the linear actuators 23 and 29 operate simultaneously so that the force arms 21 and 28 move in unison to tilt the motor 11 in any position desired by the operator of the boat.

The linear actuators 23 and 29 can be retracted so that the motor 11 is in essentially a vertical position as illustrated in FIG. 6 of the drawings or at the other extreme position, it can be tilted out of contact with the water as illustrated in FIG. 4 of the drawings. It can be trimmed to any intermediate position desired by the boat operator. This trimming operation can be achieved by the linear actuators 23 and 29 even when the motor 11 is powering the boat and the propeller 18 is rotating to produce maximum thrust. Thus it is apparent at this point that the tilt mechanism 14 can be utilized to properly trim the motor 11 so that the propeller 18 and the cavitation plate 31 are in an optimum position for efficient and effective operation of the boat while it is under a variety of load and power conditions.

Figure 1:
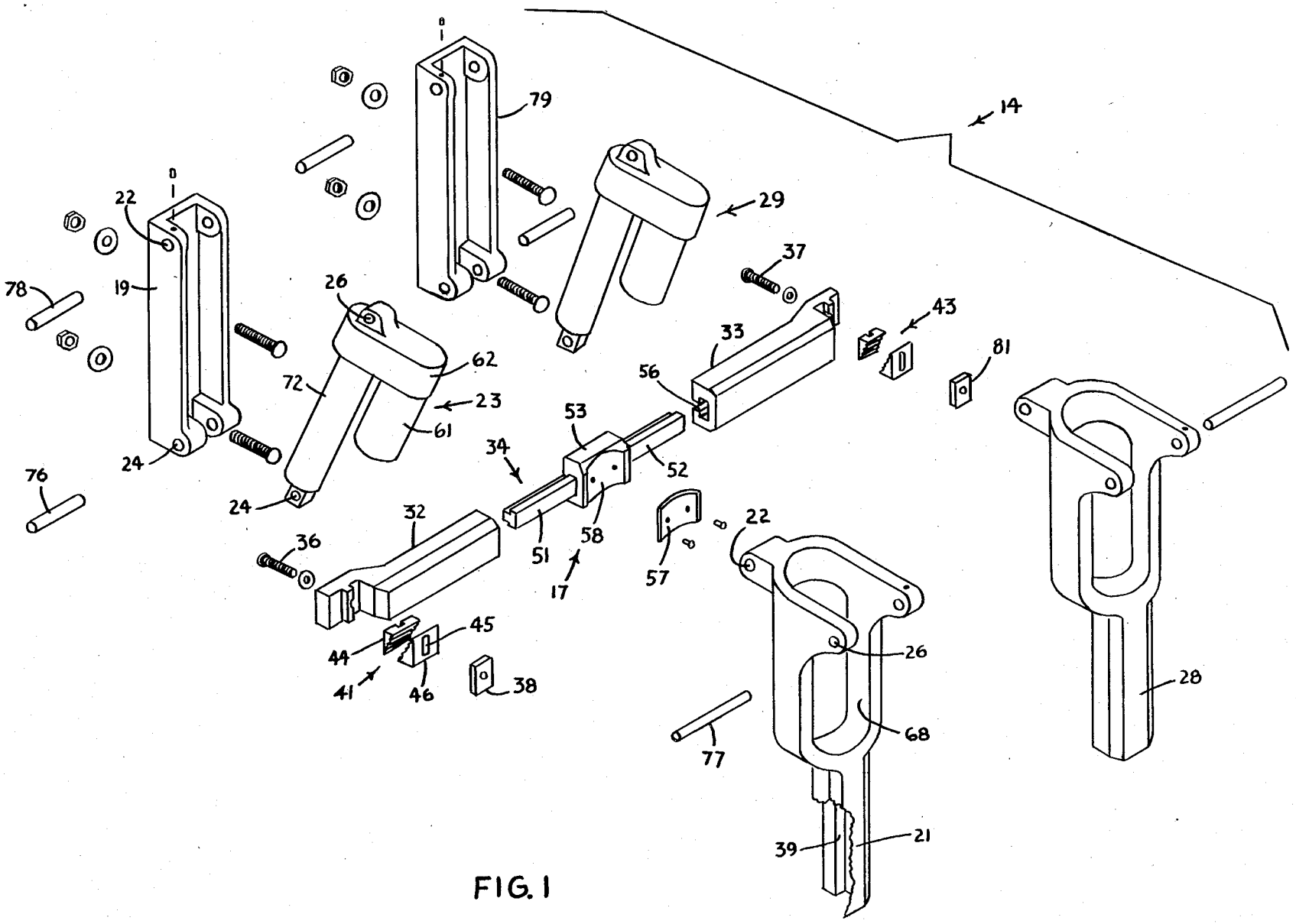
FIG. 1 is an exploded view of a trim apparatus according to the present invention.
Figure 8:
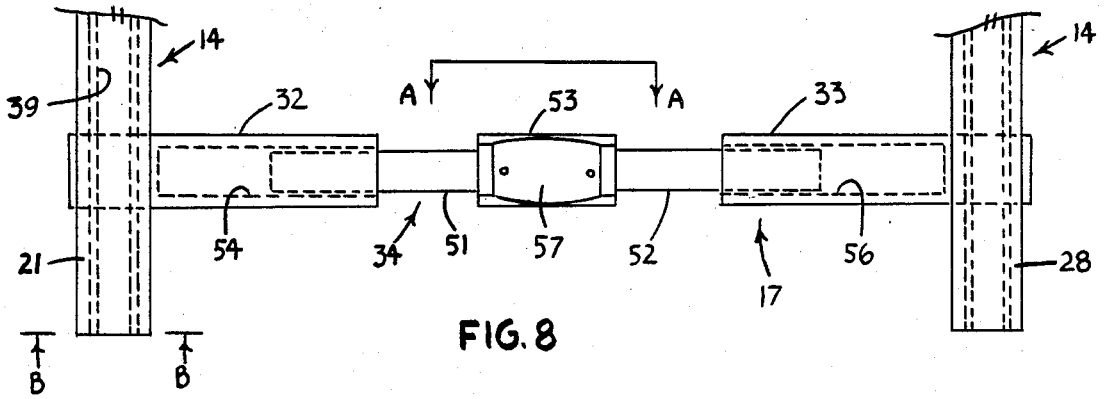
FIG. 8 is a partial plan view of the arms of a trim apparatus illustrating cross arms of a trim apparatus.
Figure 10:
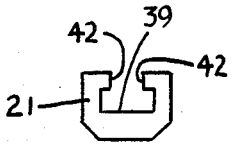

Refer now to FIGS. 1 and 8 of the drawings for a more complete understanding of the function of the cross arm 17 of tilt mechanism 14. FIG. 8 of the drawings illustrates how the cross arm assembly 17 extends between force arms 21 and 28 of the tilt mechanism 14. The cross arm assembly 17 is made up of essentially three major components, namely cross arm bracket 32, cross arm bracket 33, and T-tongue support 34. Brackets 32 and 33 are attached by bolts 36 and 37 to the force arms 21 and 28 respectively. Refer to FIG. 1 of the drawings to note the bolting mechanism used to connect the brackets 32 and 33. A flat nut 38 is designed to fit into T-channel 39 which runs along the length of the force arm 21 as illustrated in the partial section in FIG. 1 of the drawings. Another view of this T-channel 39 is illustrated in FIG. 10 of the drawings where a bottom view of the force arm 21 is illustrated. Flat nut 38 fits into T-channel 39 and bolt 36 extends through bracket 32 through spacers generally designated by numeral 41 and screws into flat nut 38 which is positioned in T-channel 39. Because of the flanges 42, the flat nut 38 will be forced against the flanges 42 when bolt 36 is tightened to securely fix the bracket 32 and tighten it to force arm 21.

Bracket 33 is attached to force arm 28 in exactly the same manner as that used for connecting bracket 32 to force arm 21. In this way, the cross arm 17 is securely attached to force arms 21 and 28.

Figure 7:
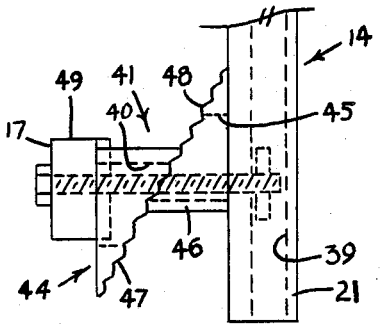
FIG. 7 is a partial side view of one arm of a trim apparatus in enlarged scale showing a spacer for adjusting a cross arm of the trim mechanism.

Each of the brackets 32 and 33 are connected to the respective force arms 21 and 28 with the use of spacers 41 and 43 respectively. Refer now to FIG. 7 of the drawings. Spacer 41 is composed of spacer blocks 44 and 46. Spacer blocks 44 and 46 are essentially beveled blocks each of which has a serrated surface, 47 and 48 respectively, which are designed to match so that the spacer blocks 44 and 46 can be positioned in contact with each other in a variety of positions. In the position noted in FIG. 7 of the drawings, the spacer blocks 44 and 46 are positioned relative to each other so that there is a maximum distance between the lip 49 of bracket 32 and the force arm 21. If, however, block 44 is moved vertically upward as viewed in FIG. 7 of the drawings so that the serrated edges 47 and 48 fully engage each other along their entire lengths, it will be noted that this would close the distance between bracket lip 49 and the surface of the lift arm 21. This permits horizontal adjustment of the bracket 32 with respect to the force arm 21 as viewed in FIG. 7 to move the cross arm assembly 17 horizontally relative to the force arm 21. Elongated slots 40 and 45 in blocks 44 and 46 respectively accommodate this adjustment along serrated edges 47 and 48. Consequently, reference to FIG. 1 of the drawings will reveal that if the spacers 41 and 43 are each adjusted in the same manner, that this adjustment moves the entire cross arm assembly 17 closer or farther away from the force arms 21 and 28 in order to accommodate motors of different sizes and shapes. These differences in motor housing shapes occur depending upon the size of the motor, the manufacturer of the motor and similar details. Accordingly, this spacer 41 and 43 function permits adjustment of the entire tilt mechanism 14 to accommodate motors of different sizes and manufacture.

The cross arm assembly 17 is also adjustable in another plane to accommodate different motors 11. Reference now to FIGS. 1 and 8 of the drawings will demonstrate this adjustable feature. T-tongue support 34 is composed of a T-tongue 51 and T-tongue 52 on either side of a pivot block 53. This is a rigid connection connecting T-tongues 51 and 52 to pivot block 53. Pivot block 53 may be attached to the T-tongues 51 and 52 by bolting, welding or similar attachment method. T-tongues 51 and 52 are designed to engage T-channels 54 and 56 in brackets 32 and 33 respectively. This can be readily observed by reference to FIG. 1 of the drawings in which it is noted that T-tongue 52 is positioned to engage T-channel 56 located in bracket 33. In FIG. 8 of the drawings, T-tongues 51 and 52 are partially inserted into T-channels 54 and 56 of brackets 32 and 33 respectively. T-channels 54 and 56 are illustrated in FIG. 8 in dotted lines. It will be observed in FIG. 8 of the drawings that force arms 21 and 28 may be moved horizontally with respect to each other by moving the arms 21 and 28 horizontally thereby engaging more or less of the T-tongues 51 and 52.

The closest that the force arms 21 and 28 can be moved together would be a position where the end of the brackets 32 and 33 each engage the pivot block 53. The force arms 21 and 28 can be moved away from each other to the extent of the length of T-tongues 51 and 52. The T-tongues 51 and 52 must engage channels 54 and 56 respectively to provide adequate support since housing 16 resting against pivot block 53 and, accordingly, the T-tongues 51 and 52 must engage a sufficient length of the T-channels 54 and 56 to provide such support. The T-tongue support 34 may be rigidly connected to brackets 32 and 33 in a variety of ways. For instance, set screws may be used to rigidly lock the brackets 32 and 33 to the T-tongues 51 and 52. Cross bolts can be used also for this fastening application. It is not deemed important to explain the detail of such a well-known fastening system at this point because it does not involve an inventive aspect of the invention.

Figure 9:
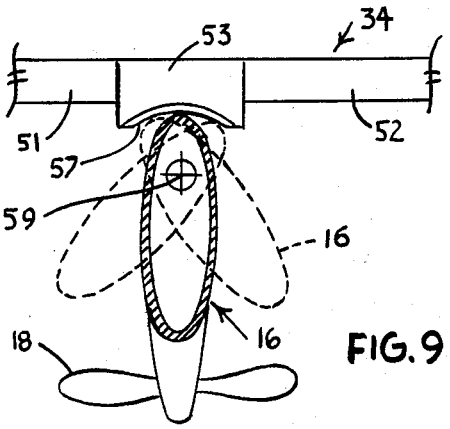
FIG. 9 is a partial top view taken generally along lines A—A of FIG. 8 and additionally showing in cross section an outboard motor housing position in three different operating positions and FIG. 10 is a bottom view of one force arm taken along line B—B of FIG. 8 showing a T-channel in the force arm.

Refer next to FIG. 9 of the drawings which illustrates the manner in which the motor 11 rests against the cross arm assembly 17. FIG. 9 is a partial view illustrating the motor housing 16 in cross section. The T-tongue support 34 is shown in top view relative to FIG. 8 and illustrates a cross sectional illustration of the motor housing 16 engaging a pad 57. Pad 57 is an antifriction device which is attached to support block 53 by a screw mechanism, by adhesives or several other well-known methods. Pad 57 should be made of an antifriction material because motor housing 16 is designed to rest against pivot block 53. When a motor is in the fully tilted position as illustrated in FIG. 4 of the drawings and also while the motor is under full power, the full thrust and weight of the motor 11 comes to bear against the pad 57. Therefore pad 57 should be made of a relatively sturdy material such as a soft metal such as copper, plastic materials such as teflons or certain of the nylon plastics and similar durable yet antifriction materials. In any event, these materials used for the pad 57 should be durable since it will be apparent at this point that the pad 57 will be under stress virtually all the time while the motor is resting on the pad 57 or the force of the thrust of the motor is applied to pad 57.

Pad 57 also is shaped in the form of an arc and is mounted in an identical arc cavity 58 (see FIG. 1) in pivot block 53. The exact radius of the arc for pad 57 will be determined to a great extent by the shape of motor housing 16. Pad 57 must be in the form of an arc because when a motor is rotated about its vertical steering axis, the housing 16 will rotate about the steering axis illustrated by numeral 59 to direct the thrust of the propeller 18. FIG. 9 demonstrates that the pad 57 must have an arc that will accommodate the housing 16 in the extreme positions which the housing 16 will occupy as the boat is being steered. The various steering positions are illustrated through the use of dotted line positions in FIG. 9. The radius of pad 57 should accommodate the housing 16 so that it approximates the radius between the axis 59 illustrated in FIG. 9 of the drawings and the forward portion of housing 16 which engages pad 57.

Figure 2:
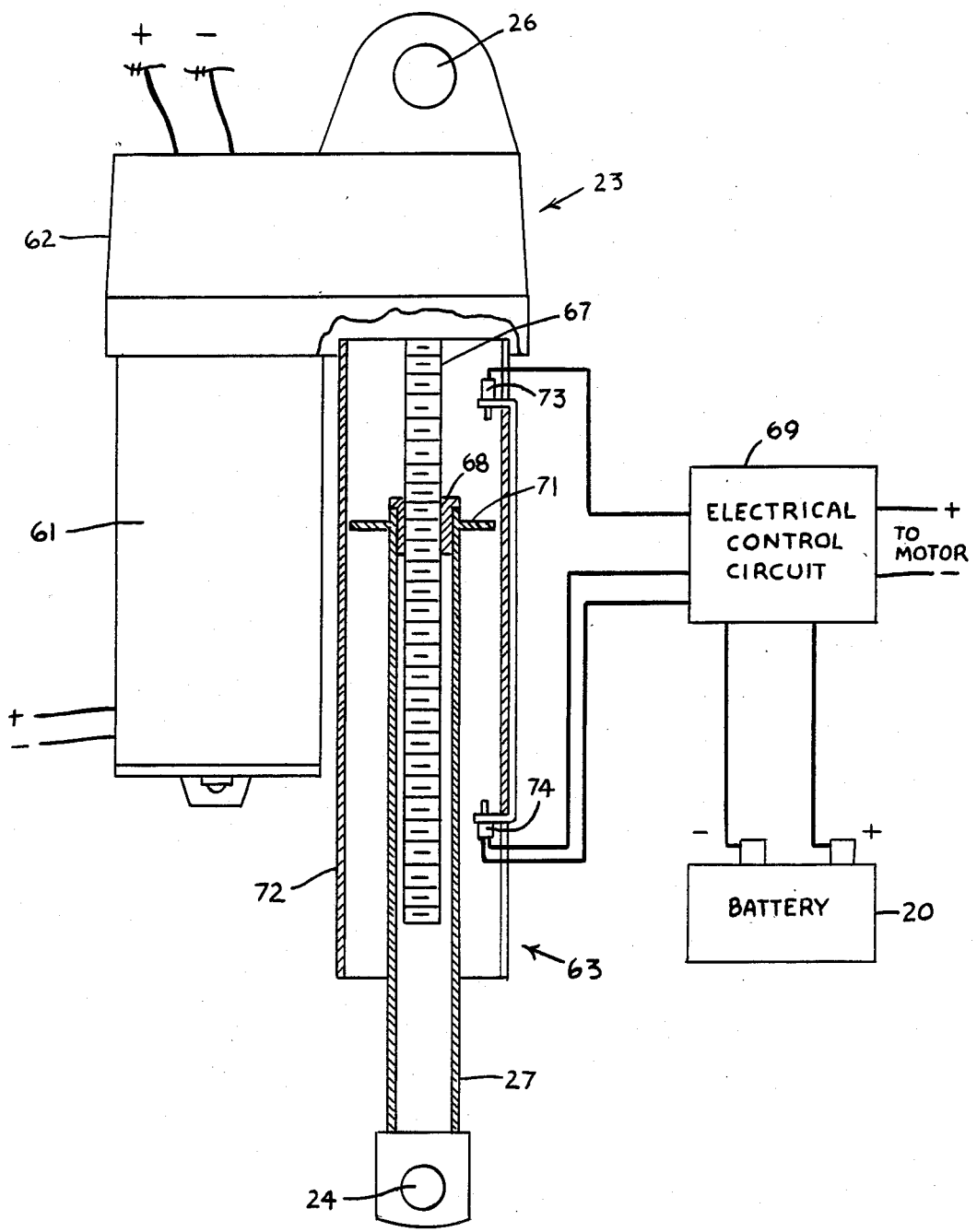
FIG. 2 is a front view, partially in sections of an electromechanical linear actuator used to power a trim apparatus.

Refer next to FIG. 2 of the drawings for a more detailed explanation of the function of the linear actuators 23 and 29. Only actuator 23 wil be referred to for the purpose of the detailed explanation. Linear actuator 23 is a combination unit consisting generally of an electrical motor 61, a gear system 62 and a drive assembly generally designated by 63. The basic function of linear actuator 23 is to provide linear force between pivot points 24 and 26 so that when the linear actuator 23 is operating, it will operate the tilt mechanism by rotating force arm 21 about a pivot point 22. Reference to FIGS. 1 and 6 of the drawings will reveal how the linear actuator 23 is connected in the force arm 21. The linear actuator 23 is designed to fit within an open housing 64 of force arm 21 and applies linear force between pivot points 24 and 26 to vary the distance between these points by changing the distance between pivot points 24 and 26 thus applying force to the force arm 21 to rotate it about pivot point 22. Linear actuator 23 accomplishes this application of force by moving drive shaft 27 vertically as illustrated in FIG. 2 of the drawings. This vertical linear movement as viewed in FIG. 2, is accomplished through the cooperation of motor 61, gear system 62 and the drive assembly 63.

Drive assembly 63 is composed of several elements that accomplishes this result. Electrical power from electric motor 61 is directed through gear system 62 and applied to a drive screw 67. Drive screw 67 is preferaby an acme screw which is connected to a gear system 62 at one end and is freely suspended from the other end.

An acme nut 68 is threaded onto acme screw 67 so that as the acme screw 67 is rotated along its own axis, the acme nut will move vertically along the acme screw 67. A drive shaft 27 is securely attached to the acme nut 68 so that as the acme screw 67 is rotating along its axis under power from the motor 61 and gear system 62, the drive shaft 27 will be driven along the axis of the acme screw 67. As viewed in FIG. 2 of the drawings, this drive direction is vertically up and down. Thus, as the acme screw 67 is first driven in one direction of rotation and then in the opposite direction of rotation by the motor 61 and gear system 62, it will selectively move the drive shaft 27 vertically upward or vertically downward as viewed in FIG. 2 of the drawings. It is therefore easily noted that as the drive shaft 27 is moved along the axis of the acme screw 67, that the distance between pivot points 24 and 26 are moved relative to each other depending upon the direction of rotation of the acme screw 67. Consequently, this drive shaft 27 applies force to the force arm 21 to rotate the force arm about a pivot point 22 as viewed in FIGS. 6 and 4 of the drawings.

The limits of travel of the shaft 27 are determined by an electrical system 69 which is connected to the electric motor 61. Drive shaft 27 has a flange 71 about its entire surface. At the end of the drive shaft 27 where it is engaged by the acme nut 68. Flange 71 and drive shaft 27 move along the inside of drive shaft housing 72. Electrical switches 73 and 74 are mounted in the drive shaft housing 72 and are connected to the electrical control system 69 to determine the vertical extent of movement of the drive shaft 27. As viewed in FIG. 2 of the drawings, the drive shaft 27 will move the pivot points 24 and 26 together until flange 71 engages electrical switch 73. When flange 71 engages switch 73, switch 73 will disconnect the power from motor 61 through the electrical control circuit 69 and stop the rotation of acme screw 67 in a direction which closes the distance between pivot points 24 and 26 (see FIG. 6).

The electrical control circuit 69 can then be actuated by an operator to rotate the acme screw 67 in the other direction by reversing the electric motor direction 61. In this mode of operation, the drive shaft 27 moves vertically downward as viewed in FIG. 2 of the drawings thereby separating pivot points 24 and 26 until flange 71 engages limit switch 74. When limit switch 74 is engaged, switch 74 will terminate operation of motor 61 and stop the application of power to the force arm 21. This represents the fully extended position of the drive shaft 27. At this point, pivot points 24 and 26 have been separated to the maximum distance. When the linear actuator 23 is in this position, the motor 11 would be in the fully tilted position illustrated by FIG. 4 of the drawings. Again, the operator may reactuate the linear actuator 23 to reverse the direction through the use of the electrical control circuit 69 to then lower the motor from the fully tilted position to an intermediate position. Trimming the motor at any intermediate position between those illustrated in FIGS. 4 and 6 is achieved by operator control of electrical control circuit 69.

The linear actuator 23 is mounted for operation on pins which will be more fully explained by reference to FIG. 1 of the drawings. The aperatures which are represented by pivot point 24 on drive shaft 27 and pivot point 24 of mounting bracket 19 are aligned so that the pivot points can be connected by pin 76. Pivot point 26 on the linear actuator 23 is aligned with pivot point 26 on the force arm 21 so that the linear actuator 23 and the force arm 21 are interconnected by pin 77. Force arm 21 is then connected to mounting bracket 19 by alignment of pivot point 22 of force arm 21 with pivot point 22 of mounting bracket 19. Pin 78 is then engaged at pivot point 22 to firmly interconnect mounting bracket 19 and force arm 21 for operation. When this assembly is accomplished, the bracket 19, force arm 21 and linear actuator 23 are interconnected and best illustrated in FIGS. 3 and 4 of the drawings which illustrate the interrelationship of these operative assemblies.

If reference is now made to FIGS. 4 and 6 of the drawings will reveal that FIG. 6 illustrates the tilt mechanism 14 in the fully retracted position with only a small portion of the drive shaft 27 exposed. In this position, pivot points 24 and 26 are in the closest relationship as explained in connection with FIG. 2 of the drawings and the motor 11 is in the fully retracted position where the motor 11 might be when the boat is in operation in the water. The motor 11 can be fully tilted by operation of the linear actuator 23 through the electrical circuit system 69 so that the electric motor 11 is energized and the acme screw 67 rotates in a direction to separate pivot points 24 and 26 against the pivot pins 76 and 77 respectively. When the linear actuator 23 is thus operating, the force arm 21 rotates about pin 78 and pivot point 22 so that the force arm rotates in an arc extending in a counter clockwise direction as viewed in FIG. 4 of the drawings to a fully tilted position demonstrated in FIG. 4 of the drawings at which point the operation of the linear actuator is terminated by actuation of switch 74 and through electrical circuit 69 which stops the application of power from motor 11 to the acme screw 67. In this position, the force arm 21 has completed a full rotation to the tilt position to tilt the motor 11 out of the water.

Figure 3:
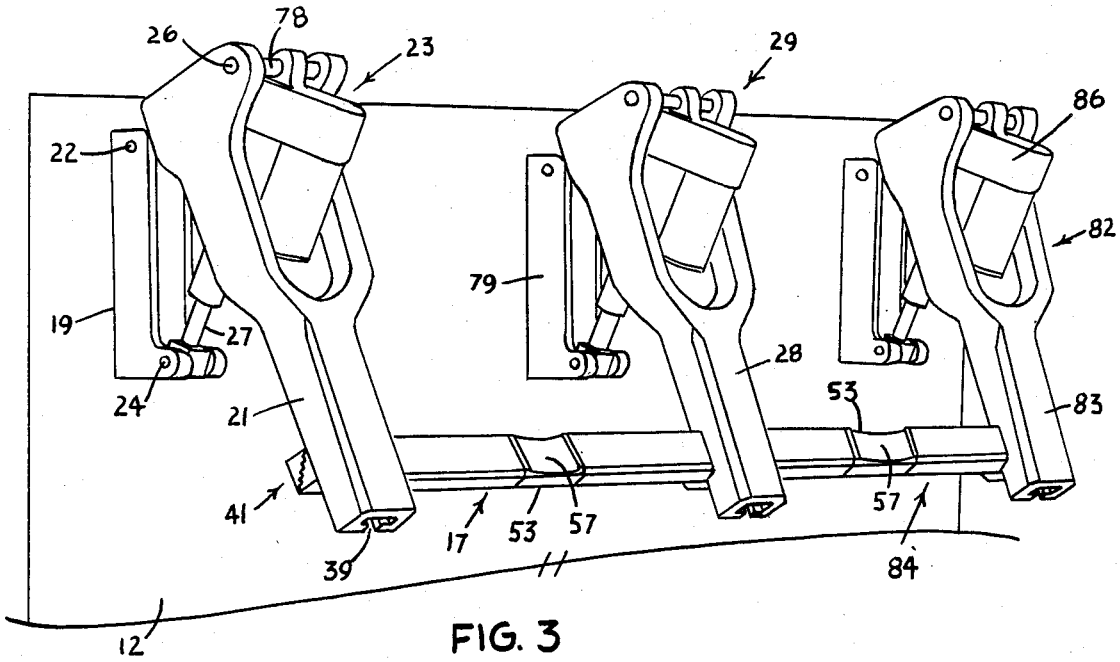
FIG. 3 is an isometric view of a trim apparatus mounted on a boat transom for trimming twin outboard motors mounted on a water craft.

The aforedescribed operation of the tilt mechanism has been set forth as though one linear actuator is in operation. In fact, the entire tilt mechanism functions in a single motor application with the simultaneous operation of two linear actuators 23 and 29 which function exactly identically. A reference to FIG. 1 of the drawing illustrates that the entire mechanism is designed to operate with two mounting brackets 19 and 79 which are attached to the transom 12 of a boat as illustrated in FIG. 3 of the drawings. To each of these mounting brackets 19 and 79 are attached identical linear actuators 23 and 29 respectively which are then connected to force arms 21 and 28 respectively as previously described in connection with linear actuator 21. The linear actuators 23 and 29 and force arms 21 and 28 are interconnected by the cross arm assembly 17 also previously described so that the housing 16 of motor 11 is engaged by the cross arm assembly 17 to be trimmed or tilted by application of power to the linear actuators 23 and 29 through electrical control circuit 69.

When the motor 11 is mounted on the boat along with the tilt mechanism 14, the tilt mechanism 14 permits substantial adjustment for the particular motor which is to be used. As previously noted, brackets 19 and 79 can be mounted a prescribed distance apart to accommodate a particular motor size by simply positioning the lift arms 21 and 28 and consequently brackets 19 and 79 apart by the use of the adjustable feature of T-tongue support 34 described earlier in this description of the preferred embodiment. This adjustable feature is illustrated in FIG. 8 of the drawings. Further, adjustment is possible along the axis of the spacing blocks 41 which are also illustrated in FIG. 7 of the drawings. Finally, the cross arm support assembly 17 can be adjusted vertically as viewed in FIG. 6 of the drawings by sliding the flat nuts 38 and 81 along T-channels 39 which are in each of the force arms 21 and 28 thus positioning the support assembly 17 vertically along the force arms 21 and 28 to the most preferred positioning for supporting the housing 16 of motor 11.

The tilt mechanism 14 described for the purpose of illustrating the invention has been a mechanism designed to function with a single motor 11. Frequently boat owners will desire to attach twin motors to boats. In this case there is a need for both of the motors to be operated simultaneously. This requires that each of the motors apply propeller thrust in the same direction at the same time at all times. Each of the motors must have the propeller 18 and the respective cavitation plates 31 aligned or trimmed exactly the same for the most efficient operation of a twin power water craft. This twin operation of motors can be accomplished by the tilt mechanism 14 contemplated by the present invention and such a twin application is illustrated in FIG. 3 of the drawings. The twin operation can be achieved by simply adding an identical force arm unit 82 to the boat transom 12 beyond the force arm 28. Force arm 83 of unit 82 can be spaced relative to force arm 28 by a cross bar support generally designated by 84 which interconnects with force arms 28 and 83 exactly in the fashion as illustrated in connection with a single motor unit. With the application of this additional force arm unit, there will need to be a slight modification of the electrical control system 69 well known in the art so that the linear actuator 86 functions simultaneously with the linear actuators 23 and 29 of force arms 21 and 28 respectively. With the application of such a force arm unit as illustrated in FIG. 3, two motors can then be mounted and then can be trimmed simultaneously by the operator of the boat as the boat is under power or the twin motors can be simultaneously trimmed or tilted out of the water as illustrated in connection with FIG. 4 of the drawing to remove both motors from the water. In all respects, the twin motor application of the invention is the same as the unit which operates with only one motor 11 except that the force arm unit 82 is an addition to the function.

There are other modifications and variations of the principles described herein which may be made to the assembly but which do not depart from the spirit and scope of the invention.

What is claimed is:

1. A mechanism for attachment to a transom of an outboard motor powered boat for trimming and tilting an outboard motor attached to the transom which consists of at least a pair of mounting brackets attached to and engaging a single surface of the transom of said boat, a force arm pivotally connected at a first pivot point to a first end of each of said brackets with a first end of a corresponding force arm, each of said force arms having a second pivot point at said first each end laterally separated from said first pivot point, a motor housing cross arm assembly interconnecting said force arms at a second end of said force arms for engaging a motor housing of said outboard motor, said mounting brackets each having a second pivot point at a second end of each of said mounting brackets, linear operating electrical power means associated with each of said mounting brackets and corresponding force arm for interconnecting the second end of each bracket at said second pivot point with the second pivot point of the corresponding force arm, and electrical control means for applying electrical power to said linear operating electrical power means to move said second pivot point on the corresponding force arm relative to the second pivot point on said mounting bracket to rotate the corresponding force arms in an arc about the first pivot point of each force arm to move the said cross arm assembly and outboard motor housing in an arc along the center line of the boat to trim the motor and tilt the motor relative to such center line.

2. A mechanism in accordance with claim 1 in which said motor housing cross arm assembly has a support block mounted on said assembly midway between the contact of said assembly with said force arms.

3. A mechanism in accordance with claim 2 in which said support block has a concave arced surface in contact with said outboard motor housing.

4. A mechanism in accordance with claim 3 in which an arced pad is attached to the arced surface of said support block to provide an antifriction contact between said arced pad and said outboard motor housing.

5. A mechanism in accordance with claim 2 in which said motor housing cross arm assembly includes a first support bracket attached to a first force arm, a second support bracket is attached to a second force arm and a T-tongue support interconnecting said first and second brackets, said first and second support brackets having T-channels which are adjustably engaged by said T-tongue support to permit the length of said cross arm assembly to be varied to adjust the distance of separation of said force arms.

6. A mechanism in accordance with claim 1 which includes three mounting brackets, first, second and third force arms interconnected with each of said brackets, a cross arm assembly interconnecting each of said force arms, and for engaging two motor housings, a section of said cross arm contacting said first and second force arm engaging a first motor and a section of said cross arm interconnecting said second and third force arms engaging a second motor.

7. An electrically powered mechanism for attachment to a transom of an outboard motor powered boat having a keel extending along a center line of the boat for trimming and tilting an outboard motor attached to the transom which comprises first and second mounting brackets attached to the transom of said boat, each of said mounting brackets having an upper and lower pivot point adapted to engage pivot pins, a first force arm having first and second pivot points at a first end of said first force arm, a second force arm having first and second pivot points at a first end of said second force arm, said first and second pivot points of each of said force arms being laterally separated from each other on each of said force arms, a first pivot pin for engaging and interconnecting the upper pivot point of said first mounting bracket and said first pivot point of said first force arm, a second pivot pin for engaging and interconnecting the upper pivot point of said second mounting bracket and said first pivot point of said second force arm, said first and second force arms each having a second end which contains a T-channel, a cross arm interconnecting said first and second force arms at a location intermediate of said first pivot point and said second end of said first and second force arms, a support block on said cross arm midway between the contact of said cross arm with said first and second force arms, said support block having an arced surface for engaging said outboard motor, a first electrically operated linear actuator pivotally interconnecting the lower pivot point of said first mounting bracket and the second pivot point of said first force arm, a second electrically operated linear actuator pivotally interconnecting the lower pivot point of said second mounting bracket and the second pivot point of said second force arm, each of said linear actuators having an electrical motor; a gear assembly and a linear screw drive for applying linear force between the lower pivot points of said mounting brackets and the second pivot points of said force arms to rotate each of said force arms and interconnecting cross arm in contact with said motor about said pivot points of said mounting brackets and in direction parallel to the keel of said boat to trim the motor, and electrical controls means for simultaneously powering said linear actuators first in one direction and then in a reverse direction to change the trim of said motor.

8. A mechanism in accordance with claim 7 in which each of said linear actuators have first electrical limit switches mounted for engagement with said linear screw drives on each of said first and second linear actuators to terminate the rotation of said first and second force arms at a predetermined maximum trim position for said motor and second electrical limit switches mounted for engagement with said linear screw drives on each of said first and second linear actuator to terminate the rotation of said first and second force arms at a predetermined minimum trim position for said motor.

9. A mechanism in accordance with claim 7 in which an adjustable spacer is mounted between the second end of each force arm and the cross arm to permit adjustment of the cross arm relative to said force arms.

10. A mechanism in accordance with claim 7 in which said support block has an arced surface in contact with the motor housing and in which said arced surface has a radius which is the same as the distance between the pivot point of said motor and the point on the motor housing contacting said arced surface.

* * * * *